United States Patent [19]

Parviainen

[11] Patent Number: 4,541,628

[45] Date of Patent: Sep. 17, 1985

[54] WEIGHT LIFTING TYPE EXERCISE DEVICE

[76] Inventor: Arno Parviainen, Lehdesniityntie 3 C, SF-00340 Helsinki 34, Finland

[21] Appl. No.: 380,920

[22] Filed: May 21, 1982

[30] Foreign Application Priority Data

Apr. 20, 1982 [FI] Finland ..... 821379

[51] Int. Cl.[4] ..... A63B 21/00

[52] U.S. Cl. ..... 272/134; 272/117

[58] Field of Search ..... 272/118, 117, 134, 143, 272/144, 93

[56] References Cited

U.S. PATENT DOCUMENTS

| | | | |
|---|---|---|---|
| 3,912,261 | 10/1975 | Lambert | 272/118 |
| 3,998,454 | 12/1976 | Jones | 272/117 |
| 4,010,947 | 3/1977 | Lambert, Sr. | 272/118 |
| 4,149,714 | 4/1979 | Lambert, Jr. | 272/118 |
| 4,195,834 | 4/1980 | Lambert, Jr. | 272/118 |
| 4,200,279 | 4/1980 | Lambert | 272/134 X |
| 4,236,712 | 12/1980 | Lambert, Jr. | 272/118 |
| 4,239,210 | 12/1980 | Lambert, Jr. | 272/118 |
| 4,240,626 | 12/1980 | Lambert | 272/118 |
| 4,256,302 | 3/1981 | Keiser et al. | 272/134 X |
| 4,257,592 | 3/1981 | Jones | 272/126 |
| 4,311,305 | 1/1982 | Lambert et al. | 272/118 |
| 4,322,071 | 3/1982 | Lambert, Jr. et al. | 272/118 |
| 4,333,644 | 1/1982 | Lambert, Jr. et al. | 272/118 |
| 4,349,191 | 9/1982 | Lambert, Jr. et al. | 272/118 |
| 4,349,192 | 9/1982 | Lambert, Jr. et al. | 272/118 |
| 4,349,193 | 9/1982 | Lambert, Jr. et al. | 272/118 |
| 4,349,194 | 9/1982 | Lambert, Jr. et al. | 272/134 |

*Primary Examiner*—Richard J. Apley
*Assistant Examiner*—William R. Browne
*Attorney, Agent, or Firm*—Fleit, Jacobson, Cohn & Price

[57] ABSTRACT

An exercise device containing a frame having a front and rear section and an athlete's body receiving support elements, an operating element to rotatably receive the forces exerted by the members of the body of an athlete seated in the support elements, an eccentric rotatable element fitted to the operating section in order to direct the forces applied to the latter over to the eccentric element, a counter force element mounted on the eccentric element by a rope element in a manner that the counter-force element resists the force applied to the operating element with a counter-force by way of the rope element and the eccentric element. The operating element is connected to the eccentric element by two transmission gears flanking the support elements and by a substantially rope-shaped transmission element as well as by two rearward transmission gears, with the eccentric elements being mainly disposed behind the support elements, and that the transmission gears plus their transmission elements are encapsulated. The rear section of the frame contains a vertical frame portion and the front section comprises a substantially rectilinear inclined frame portion tilted against the vertical frame portion, and that the frame portions are joined together by their bases with a horizontal frame portion.

1 Claim, 7 Drawing Figures

Fig.1
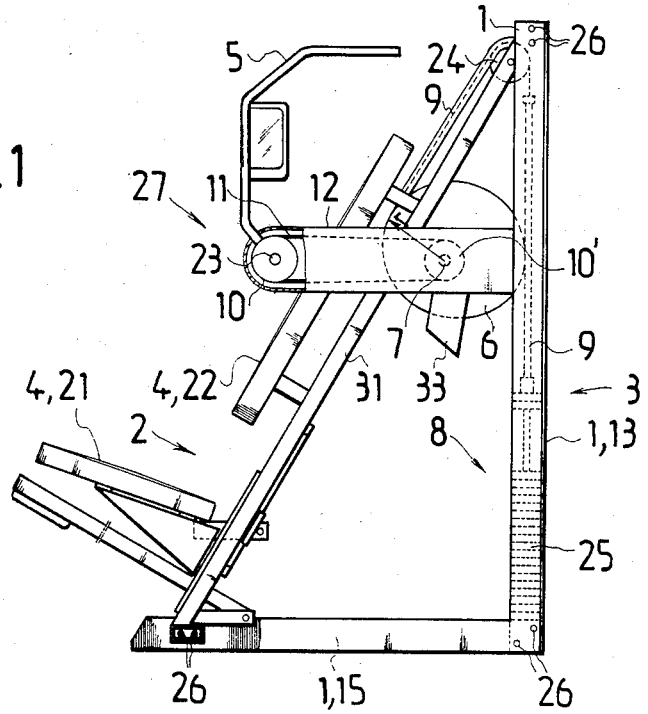
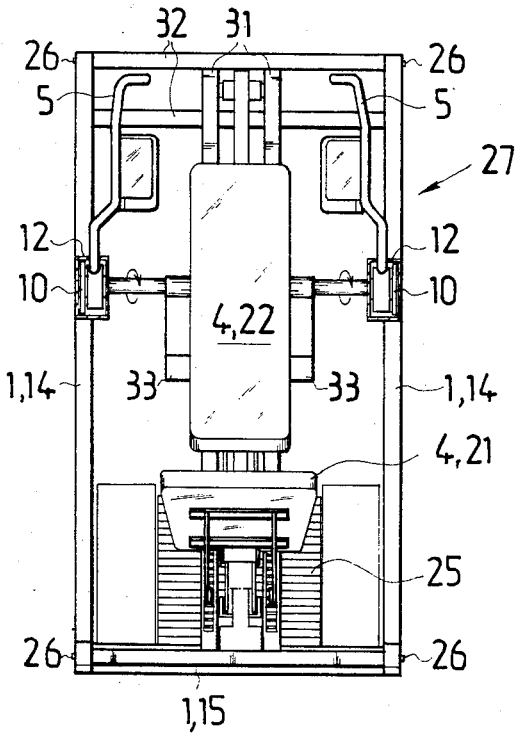
Fig.2

WEIGHT LIFTING TYPE EXERCISE DEVICE

The present invention relates to an athletic exercise device, as defined in the preamble of claim 1. Physical exercise equipment has earlier been disclosed in U.S. Pat. Nos. 3,858,873, 3,912,261, 3,998,454, 4,200,279. When an exercise device is used, a given muscle and joint is exercised by turning an operating means by a muscle and joint to be exercised, the motion and load being transmitted by way of an eccentric and rope means to a counter-load device which resists a force applied to the operating means with a counter-force. For exercising various muscles and joints there are known in the art exercise devices of various designs, as set forth in the above-cited references.

Power transmission in exercise equipment is usually effected by means of pulleys and chains. During the exercise session, a gymnast holds on to a support means which is usually positioned in the middle of an exercise device, partially inside it. When doing gymnastics, the transmission means are thus within the reach of a gymnast's fingers, hands and clothing and mean a hazard to a gymnast. The eccentrics used in such equipment are usually relatively bulky, with a radius of e.g. 200–400 mm, and they move the chains at a high velocity making a lot of noise and causing disturbing vibration during the movements. Thus, the gymnastic exercise devices are generally hazardous, greasy, unpleasant and noisy. Since gymnastics and body-building exercises have lately become more and more popular especially among women, the prior art exercise devices do not satisfy the safety, hygienic, attractiveness and aesthetic demands.

The exercise devices set forth in the above references for building various muscles and joints differ completely from each other as to their designs. Thus, at present, the exercise of various muscles and joints requires totally different exercise devices, thus requiring separate planning and manufacturing for each piece of equipment. There are very few common components that can be presently fitted to various devices which, in turn, increases manufacturing costs and retail prices of the equipment.

SUMMARY OF THE INVENTION

An object of the present invention is to overcome the above drawbacks. A particular object of the invention is to provide an exercise device which does not involve hazards and is safe to the user and which does not have exposed noisy, greasy and hazardous chains and pulleys. A further object is to provide an exercise device which is silent and pleasant and attractive in appearance and service. Another object of the invention is to provide an exercise device that can be adapted to the manufacture in different embodiments for building various muscles and joints in a manner that the exercise devices intended for building various muscles and joints have, in addition to their design, a substantially uniform and aesthetically attractive appearance.

An arrangement according to the invention for connecting an operating means to an eccentric is substantially less hazardous, a lot safer, more hygienic, aesthetic and pleasant than the prior art solutions.

A frame assembly used in the exercise device with its vertical, inclined and horizontal frame elements is likewise aesthetically more attractive and at the same time permits the use of an element structure for composing various pieces of exercise equipment for building various muscles and joints from the same frame elements. Thus, an exercise device of the invention combines safety, attractiveness, aesthetic and practical aspects and, as a result, the invention provides an exercise device that meets the above requirements and, moreover, is more economic than the prior art exercise device as for its manufacturing and operating costs.

BRIEF DESCRIPTION OF THE DRAWINGS

In the following, the invention is described in detail by means of exemplified embodiments with reference to the accompanying drawings in which:

FIGS. 1–2 illustrate an exercise device for building the muscles of the chest, back and shoulders in a side and front view, respectively.

DESCRIPTION OF THE PREFERRED EMBODIMENTS

Figure 3:
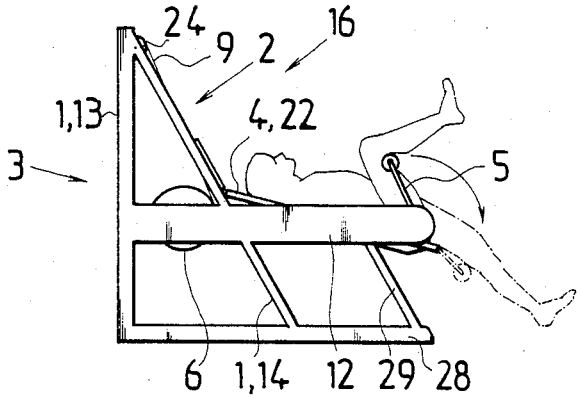
FIGS. 3–7 illustrate in a side view and schematically exercise devices for building extensors of the body, flexor of the arm, flexors of the thigh and extensors of the thigh, respectively.
Figure 4:
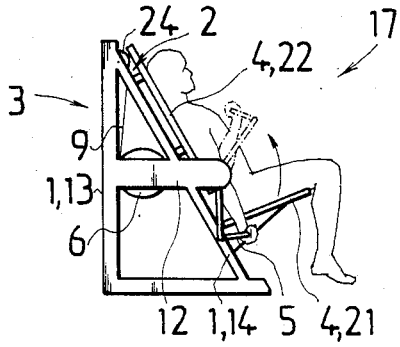
Figure 5:
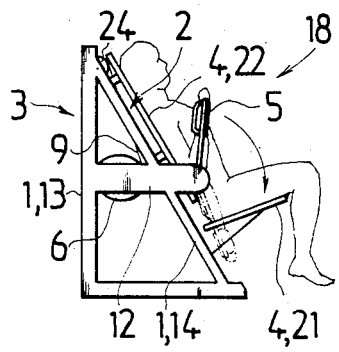

An exercise device illustrated in FIGS. 1–2 comprises a frame 1 having a face and rear side 2, 3 and provided with the body of a gymnast receiving support means 4, an operating means 5, an eccentric 6 with its axle 7 as well as a counter-force assembly 8 with its rope means 9. The support means 4 comprises a seat 21 and a back rest 22 disposed substantially in the middle of the face side and projecting forwardly. The operating means 5 comprises two lever arms mounted on the face side 2 of frame 1 and rotatable relative to a horizontal and laterally extending axle 23, said lever arms being connected by means of transmission elements to said eccentric 6. Eccentric 6 is likewise journalled on frame 1 rotatably relative to its horizontal, laterally extending axle 7. The counter-force assembly 8 is disposed on the rear side 3 of said frame and coupled to eccentric by means of a rope element 9 extending therearound via a roller 24 mounted on the top of the frame. The counter-force assembly 8 consists of adjustable counter-weights 25 disposed on rear side 3 of frame 1 for up and down movement, the rope element 9 being arranged to lift said counter-weights upwards as the work-out force is applied to the operating means and the latter rotates relative to its axle 23, so that the attractive force applied to said counter-weight resists the turning motion of said operating means by way of said rope element 9, eccentric 6 and transmission elements of the operating means. The magnitude of said counter-force changes as a moment arm of the rope element extending around eccentric 6 changes, that is as a support radius r acting on the rope element changes along with rotation of the eccentric.

According to the invention, the operating means 5 is connected to eccentric 6 by means of two, said support means flanking forward transmission gears 10 as well as chain-like, i.e. rope-like transmission elements 11 and transmission gear 10', said eccentric elements being disposed substantially on the rear side of support means in shelter with the rearward transmission gears on the same axle 7 as the eccentric elements. Thus, by virtue of the invention, an athlete seated in the support means 5 cannot at all come in contact with eccentric 6, rope means 9, transmission gears 10, 10' and/or transmission elements 11 due to the disposition and encapsulation thereof.

In the embodiment depicted in FIGS. 1–2, frame 1 is constructed of elements and comprises a vertical frame portion 13 which makes up a rear section 3, a substantially rectilinear inclined frame portion 14 which makes up a front section 2 and is tilted against said vertical frame portion, as well as a horizontal frame portion 15 which connects the former frame portions together and makes up the bottom element of the frame. Said frame portions are substantially rectangular in configuration and assembled of profiled metal beams. Frame portions or elements are joined together by bolt joints 26. In addition, in the present embodiment, the vertical 13 and inclined 14 frame portions are joined together with horizontal boxes 12 housing transmission gears 10, 10' and elements, these joints being effected by welding. Thus, said boxes 13 extend horizontally from the rear section 3 on to the front section 2 of frame 1 on the same level and project forwardly of support means 4 flanking the same.

The frame of the exercise or work-out device shown in FIGS. 1–2 is of sample, clear-cut, compact and stable design and economic as to its building costs. In the present embodiment, the rope element 9 comprises a transmission strap, such a transmission strap made of polyamide or e.g. a fabric-reinforced plastic structure and, furthermore, due to the encapsulation of transmission elements for the operating means and the disposition of those and the eccentric elements, operation of the device is, on top of the above advantages, noiseless and the quiet yielding movements feel smooth, frictionless and pleasant. As for the general impression, the device is simple, streamlined and appealing as well as more attractive and in every way more pleasant than the corresponding prior art devices.

FIGS. 3–7 exhibit the excellent adaptability of the frame structure of an exercise or work-out device of the invention as the frame for various work-out assemblies. The device shown in FIGS. 1–2 is intended for working on the major muscle bundles of the upper body and devices illustrated in FIGS. 3–7 mainly differ from the above device as to the operating means 5 and the box 12 which effects on the position of said operating means and, in FIGS. 4 and 7, the differences are limited to the rotational direction of operating means 5, transmission elements 10, 11 and eccentric 6, said direction being reversed by passing the rope element 9 to the eccentric element from the opposite side, i.e. from the rear in view of what is illustrated in FIG. 1.

Figure 6:
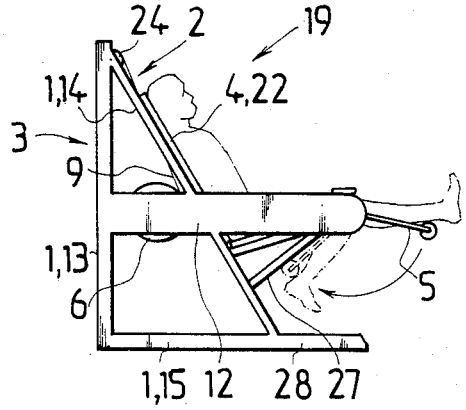
Figure 7:
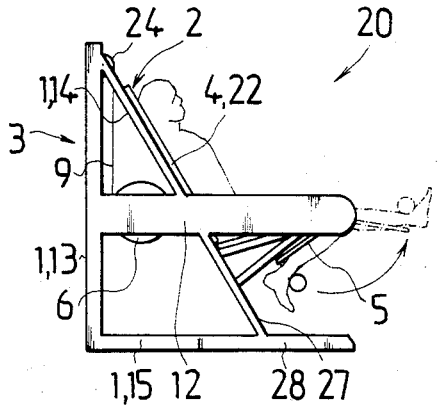

FIGS. 6 and 7 illustrate devices for working on the flexors and extensors of a thigh and, in these devices, the assembly of operating means 5, its transmission elements 10, 10', 11 and its box or housing 12 is positioned further forward than in the devices shown in FIGS. 1–2 and 4–5, said box being also fitted further down then in the device shown in FIGS. 1–2.

FIG. 3 illustrates a device for working on back muscles, wherein the operating means 5, its transmission elements 10, 10', 11 and its box or housing 12 are positioned still further forward than those in the devices shown in FIGS. 6–7. The horizontal frame portion 15, which forms the base of frame 1, has been provided with a forward extension 28. The support means 4 has been propped up by additional supports 29 whose lower ends are supported on the horizontal, transversely extending frame portion 15 which connects the extensions 28 together with bolt joints 26.

The upper ends of said additional supports prop up the support means 4 by way of a transverse frame portion 30 which connects boxes or housing 12 together with bolt joints 26.

In FIGS. 1–2, the support means 4, 21 and 22 is bracketed to two tubes 31 extending parallel to frame portion 14, i.e. the inclined tubes 14, the lower ends of said tubes 31 being anchored to the horizontal, transversely extending frame portion 15 and the upper ends thereof being anchored to a double-beam 32 which joins the flank elements together. The design is the same in all machines (FIGS. 1–7) with the exception of a body extensor (FIG. 3), as specified above.

Devices depicted in FIGS. 3–7 are essentially based on the same frame elements, transmission elements and basic design as that illustrated in FIGS. 1–2. Thus, the exercise or work-out devices can be manufactured by using the same elements and components.

In the embodiments illustrated in FIGS. 1–7, the eccentric elements 6 are provided with counter-weights 33 which are shown in FIGS. 1–2 and which are there to balance the imbalance caused by the eccentricity of operating means 5.

The invention is not restricted to the above-described embodiments which can be modified and varied within the scope of the appended claims.

I claim:

1. An exercise device comprising:

a frame including a front section and a rear section, the rear section comprises a vertical portion of said frame and the front section comprises a substantially rectilinear inclined portion of said frame, said front section being tilted against the rear section and being joined together at one end;

support means located substantially equidistantly from the sides of the front section and in front of the front section for supporting an operator;

a first axle extending parallel to and horizontally between said front section and said rear section;

an eccentric element mounted centrally on said first axle behind said support means;

first transmission gear means mounted at both ends of the first axle;

two second axles located on the opposite side of the front section from the first transmission gear means and on the same side of the front section as the support means;

second transmission gear means located at one end of each of said two second axles, said second transmission gear means located on flanking sides of the support means;

operating means secured to the other end of each of said two second axles and being rotatable with said two second axles for receiving forces exerted on said operating means by the operator when seated in said support means and said operating means transferring the forces to said second transmission gear via said two second axles;

first transmission means interconnecting said first transmission gear means and each said second transmission gear means transferring movement of each of the second transmission gear means to said first transmission gear means, said first axle and said eccentric element;

counterforce means located adjacent to the rear section being vertically movable between a rest position and an elevated position for resisting movement in response to force being applied to the operating means by a user;

second transmission means interconnecting said eccentric element and said counterforce means transferring movement of the eccentric member via said operating means to said counterforce means; and enclosure means located on flanking sides of the support means surrounding said first transmission gear means, said second transmission gear means, said first transmission means and both ends of said first axle, said enclosure means being secured to the front section and said rear section, interconnecting said front section and said rear section, said enclosure means extending horizontally on both sides of the support means from the rear section to the support means.

* * * * *